US008733435B2

(12) United States Patent
Webb

(10) Patent No.: US 8,733,435 B2
(45) Date of Patent: May 27, 2014

(54) COLLECTOR DEVICE FOR DRILLING FLUID

(75) Inventor: Jonathan Garrick Webb, Kristiansand (NO)

(73) Assignee: National Oilwell Norway AS, Kristiansand (NO)

( * ) Notice: Subject to any disclaimer, the term of this patent is extended or adjusted under 35 U.S.C. 154(b) by 781 days.

(21) Appl. No.: 12/664,979

(22) PCT Filed: Jun. 11, 2008

(86) PCT No.: PCT/NO2008/000209

§ 371 (c)(1),
(2), (4) Date: Mar. 16, 2010

(87) PCT Pub. No.: WO2008/153410

PCT Pub. Date: Dec. 18, 2008

(65) Prior Publication Data

US 2010/0200216 A1 Aug. 12, 2010

(30) Foreign Application Priority Data

Jun. 15, 2007 (NO) ..... 20073057

(51) Int. Cl.
*E21B 19/00* (2006.01)

(52) U.S. Cl.
USPC ..... 166/81.1; 166/228; 285/13

(58) Field of Classification Search
USPC ..... 166/81.1, 93.1, 97.1, 228; 285/13, 14
See application file for complete search history.

(56) References Cited

U.S. PATENT DOCUMENTS

| | | | | | |
|---|---|---|---|---|---|
| 234,825 | A | * | 11/1880 | Walker | 166/81.1 |
| 1,632,889 | A | * | 6/1927 | Davis | 166/81.1 |
| 2,096,882 | A | * | 10/1937 | Chernosky | 166/81.1 |
| 2,282,675 | A | * | 5/1942 | Pigott | 138/46 |
| 2,506,790 | A | * | 5/1950 | Ihrig et al. | 417/375 |
| 2,522,444 | A | * | 9/1950 | Grable | 166/81.1 |
| 2,610,690 | A | * | 9/1952 | Beatty | 166/81.1 |
| 2,674,474 | A | * | 4/1954 | Lister | 166/84.2 |
| 3,252,270 | A | * | 5/1966 | Pall et al. | 95/143 |
| 3,284,110 | A | * | 11/1966 | Marcus et al. | 285/235 |
| 3,559,739 | A | | 2/1971 | Hutchison | |
| 3,595,607 | A | * | 7/1971 | Gores | 422/123 |
| 3,679,237 | A | * | 7/1972 | De Angelis | 285/109 |
| 3,901,448 | A | * | 8/1975 | Babin | 239/145 |
| 4,027,519 | A | * | 6/1977 | Bachle | 72/370.23 |
| 4,094,466 | A | * | 6/1978 | DeRomano | 239/145 |
| 4,355,826 | A | | 10/1982 | Von Braun | |
| 4,409,896 | A | * | 10/1983 | Hamisch, Jr. | 101/367 |
| 4,450,905 | A | * | 5/1984 | Crain | 166/81.1 |
| 4,542,787 | A | * | 9/1985 | Parker | 166/81.1 |
| 4,624,319 | A | * | 11/1986 | Van Der Borght | 166/369 |

(Continued)

FOREIGN PATENT DOCUMENTS

| | | | | |
|---|---|---|---|---|
| GB | 2264965 | A | * | 9/1993 |
| GB | 2420362 | A | | 5/2006 |

(Continued)

*Primary Examiner* — Yong-Suk (Philip) Ro
(74) *Attorney, Agent, or Firm* — Conley Rose, P.C.

(57) ABSTRACT

A collector device for collecting drilling fluid from a pipe during disconnecting of the pipe from a pipe string comprises a collecting space. At least a portion of the collecting space is provided with a porous material. In an active position, the collector device is configured to surround a pipe coupling of the pipe string.

12 Claims, 2 Drawing Sheets

(56) References Cited

U.S. PATENT DOCUMENTS

Figure 1:
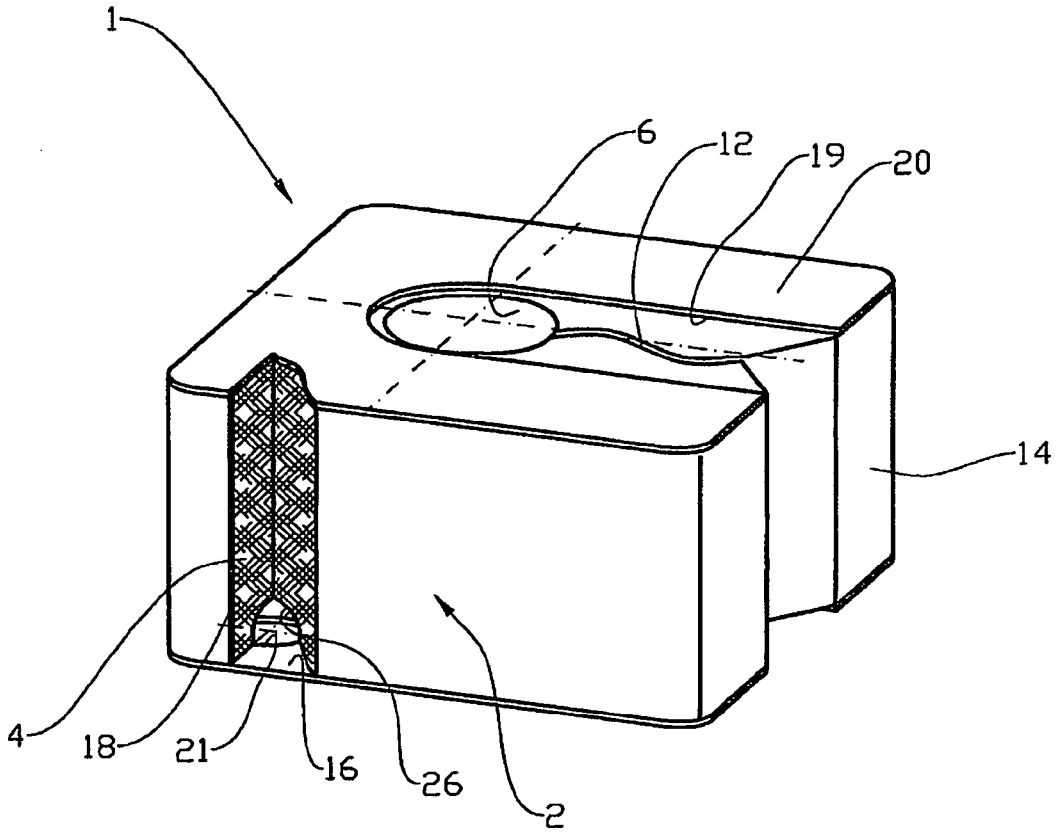

| | | | | | |
|---|---|---|---|---|---|
| 4,997,000 | A | * | 3/1991 | Feast et al. | 134/170 |
| 5,150,751 | A | * | 9/1992 | Burton et al. | 166/81.1 |
| 5,295,536 | A | * | 3/1994 | Bode | 166/81.1 |
| 5,351,753 | A | * | 10/1994 | Golson | 166/81.1 |
| 6,119,772 | A | * | 9/2000 | Pruet | 166/81.1 |
| 2007/0169931 | A1 | * | 7/2007 | Holthe | 166/81.1 |
| 2010/0218934 | A1 | | 9/2010 | Halse | |

FOREIGN PATENT DOCUMENTS

| | | | |
|---|---|---|---|
| RU | 2126715 | C1 | 2/1999 |
| UA | 32410 | U | 5/2008 |
| WO | 0186112 | A2 | 11/2001 |
| WO | 2005073499 | A1 | 8/2005 |

* cited by examiner

COLLECTOR DEVICE FOR DRILLING FLUID

CROSS-REFERENCE TO RELATED APPLICATIONS

The present application claims the benefit of priority to PCT/NO2008/000209 filed Jun. 11, 2008, which claims the benefit of Norwegian Application No. 20073057 filed Jun. 15, 2007, both of which are incorporated herein by reference in their entirety for all purposes.

STATEMENT REGARDING FEDERALLY SPONSORED RESEARCH OR DEVELOPMENT

Not applicable.

This invention relates to a collector for drilling fluid (mud bucket). More particularly it concerns a collector for drilling fluid flowing out of a pipe during disconnection of the pipe from a pipe string, the collector in its active position surrounding the pipe coupling. The collector collecting space includes a porous material.

In the following all indications of directions are referred to the operating position of the collector, typically on a drill floor.

When a pipe string, e.g. in the form of a drill string, is to be pulled up from a well, piping, or a connection of several pipes, must be disconnected from the pipe string as the pipe string is pulled up.

The disconnection is carried out often by means of so-called power tongs (mechanical roughneck) where a holding tong grips a part of the drill string rising above the drill floor, and where a work tong, turning about the longitudinal axis of the pipe, grips the pipe to be disconnected. The work tong loosens the pipe from the pipe string and thereafter turns the threaded-portion out of a corresponding socket portion of the pipe string at the same time as the work tong is moved upwards relative to the holding tong.

Pipe strings are often filled with drilling fluid when they are pulled up. The pipe, which is to be disconnected from the pipe string, typically contains several hundred liters of drilling fluid flowing out from the pipe connection when the threaded portion of the pipe is unscrewed from the socket portion. The drilling fluid has, due to the static head in the pipe, a considerable flow velocity during discharge.

Drilling fluid flowing out pollutes the working area and the surroundings. The drilling fluid is in addition relatively costly. It is common to collect the drilling fluid by means of suitable tools.

According to prior art a collecting container is positioned around the pipe coupling when the pipe is disconnected from the pipe string. The collecting container is provided with the necessary seals and baffle plates to be able to slow down the speed of the fluid and collect the flowing drilling fluid. Due to the size of the collecting container, it is necessary to move the power tongs, which is U-shaped, away from the connector after the pipe is loosened from the pipe string to give sufficient room for the collecting container.

The pipe is unscrewed by means of e.g. a top driven rotary system while the collecting container encloses the pipe coupling. Collected drilling fluid is drained via an outlet away from the collecting container.

Necessary removal of the power tongs to give room for the collecting container considerably delays work during disconnection of pipes from the pipe string when conventional U-shaped power tongs are utilized.

When enclosing power tongs, so-called 360 degree tongs, are used, it is common to position a split collector provided with the necessary seals, between the holding tong and the working tong.

The object of the invention is to remedy or reduce at least one of the prior art drawbacks.

The object is achieved according to the invention by the features given in the description below and in the following claims.

In accordance with the invention a collector for drilling fluid from a pipe during disconnection of the pipe from a pipe string, where the collector in its active position encloses the pipe coupling, is characterised in that whole or part of the collector space of the collector is provided with a porous material.

The porous material may have varying porosity in the various portions of the collector space. It may be desirable that the porous material that is located closest to the pipe coupling has less density than the material that is located closer to the collector wall portions.

The porous material may be constituted by for example a fibre material or by a foam material having open pores, or a combination thereof.

Current materials may be natural fibres such as hemp, or an artificial fibre such as aramide. After foaming several artificial materials are suitable for the purpose.

The collector is provided with a gap running from the through vertical opening of the collector and out to one of the collector side portions. The collector is thus shaped to be able to be displaced radially in over a pipe or a pipe coupling.

Preferably, the gap is non-plane to avoid drilling fluid splashing out via the gap.

The porous material is preferably relatively flexible, and it is advantageous to support the collector with a relatively rigid bottom plate provided with at least one drain opening.

The at least one drain opening communicates with an outlet or a collector. The fibre material may be provided with drain ducts leading to the drain opening.

To counteract leakage from the collector side portions, the side portions are most preferably covered by a flexible plate, for example a rubber material. Advantageously, also the topside of the collector is provided with a relatively rigid top plate.

The collector may be connected to the topside of the holding tong. The collector is thereby positioned between the holding tong and the working tong. When a pipe is to be loosened, the collector is displaced in over the pipe coupling together with the holding tong, as the gap flexibly opens for the pipe coupling during the insertion. The gap closes when the pipe coupling is in the vertical opening. The collector is compressed somewhat when the working tong is displaced toward the holding tong.

When the threaded portion of the pipe is unscrewed from the socket portion of the pipe string, drilling fluid flows out from the pipe coupling and into the collector porous material where the drilling fluid flow speed is reduced at the same time as the porous material is filled with drilling fluid.

Simultaneously the drilling fluid flows out through the at least one drain opening in the bottom plate and down into an outlet or a collector.

As the working pipe tong during disengagement is displaced in a direction upward from the holding tong, the collector expands and maintains thereby its sealing position about the pipe coupling until the drilling fluid has flowed out from the pipe.

The invention provides a collector for drilling fluid, which is particularly well suited for use together with U-shaped power tongs. The invention simplifies to a considerable extent the work operations in disconnecting pipes from the pipe string, at the same time as the collector according to the invention, compared to prior art, exhibits a considerable reduction in investment costs.

Figure 2:
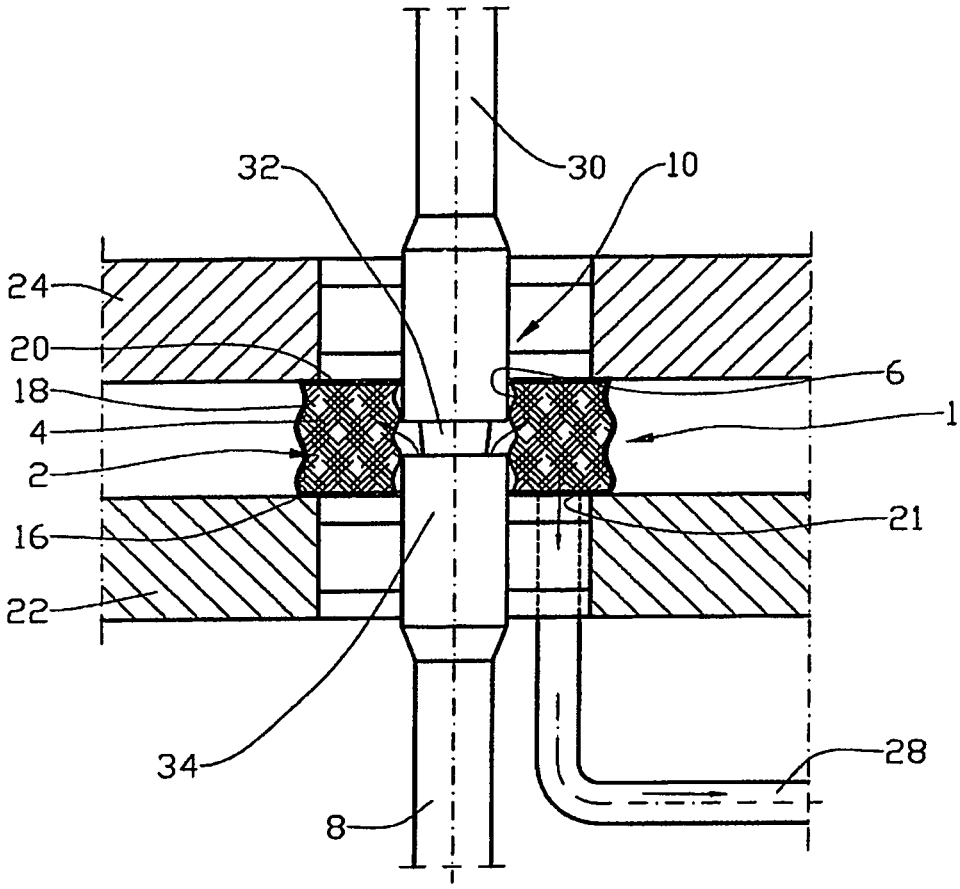

In the following an example of a preferred embodiment is described and illustrated in the accompanying drawings, wherein:

FIG. 1 shows in perspective and partly in section a collector in accordance with the invention; and FIG. 2 shows schematically, in a somewhat smaller scale, the collector mounted between a holding tong and a working tong during disconnection of a pipe from a pipe string.

In the drawings, the reference numeral 1 indicates a collector where the collecting space 2 in the collector 1 is filled with a porous and flexible fibre material 4. The fibre material 4 may be foamed.

The collector 1 is provided with an in the operational position vertical opening 6 which complimentary fits about a pipe coupling 10 of a pipe string 8. A gap 12 runs mainly vertically in a radial direction from the opening 6 and out to the collector side portion 14. The gap 12 is given a wavy shape to prevent that drilling fluid shall be able to splash out through the gap 12.

The collector 1 is on its underside provided with a relatively rigid bottom plate 16, while a sealing, flexible plate 18 covers the side portions of the collector 1. The topside of the collector 1 is provided with a top plate 20. The bottom plate 16 and the top plate 20 are provided with U-shaped recesses 19, being wider than the largest current pipe diameter. The bottom plate 16 is provided with a drain opening 21.

The collector 1 is positioned between a holding tong 22 and a working tong 24, see FIG. 2, where the collector 1 in its operating position surrounds the pipe coupling 10.

The drain opening 21 of the bottom plate 16, which most advantageously communicates with a collecting channel 26 in the fibre material 4, is connected to an outlet 28. The outlet 28 is normally connected to the holding tong 22.

When a pipe 30 is to be disconnected from the pipe string 8, the tongs 22, 24 together with the collector 1 is displaced in over the pipe coupling 10 of the pipe string 8 in that the gap 12 opens up and thereafter closes when the pipe coupling is positioned in the opening 6 of the collector 1.

The holding tong 22 engages the pipe string 8 and prevents the pipe string 8 from turning about its longitudinal axis, while the holding tong 24 engages the pipe 30 and loosens the threaded portion 32 of the pipe 30 from the socket portion 34 of the pipe string 8. The threaded portion 32 and the socket portion 34 together form one of the pipe couplings 10 of the pipe string 8.

When the threaded portion 32 is unscrewed from the socket portion 34, the working tong 24 is displaced somewhat upwards from the holding tong 22. The collector 1, being somewhat compressed, expands and fills the opening between the tongs 22, 24.

Simultaneously, the drilling fluid flows out from the pipe coupling 10 and into the porous material 4 in the collector space 2. The flow rate of the drilling fluid is reduced while the collector space 2 is filled. At the same time drilling fluid flows via the collecting channels 26 and the drain openings 21 into the outlet 28. Arrows in FIG. 2 indicate the flow of drilling fluid.

The collector 1 prevents leakage to the environment by sealingly surrounding the pipe coupling 10 during the drilling fluid discharge. The collector is all along positioned between the tongs 22, 24 and it is thus unnecessary to remove these during the disconnecting operation.

The invention claimed is:

1. A collector device for drilling fluid from a pipe during disconnecting of the pipe from a pipe string, the collector device comprising:

a housing having a first end, a second end opposite the first end, and a side portion extending from the first end and the second end;

a drilling fluid collecting space within the housing;

a porous material disposed in the drilling fluid collecting space of the housing, wherein the porous material is configured to receive drilling fluid emitted from a gap between the pipe and the pipe string and allow the drilling fluid to flow through the porous material;

wherein, in an active position, the porous material is configured to be disposed about the gap between the pipe and the pipe string and axially span the gap between the pipe and the pipe string.

2. The collector device in accordance with claim 1, wherein the porous material has a porosity that varies in different portions of the collecting space.

3. The collector device in accordance with claim 1, wherein the porous material comprises a fibre material.

4. The collector device in accordance with claim 1, wherein the porous material comprises a foam material with open pores.

5. The collector device in accordance with claim 1, wherein the housing further comprises:

a vertical opening having a central axis and extending vertically through the housing from the first end to the second; and a gap extending vertically through the housing from the first end to the second and extending radially from the vertical opening through the side portion.

6. The collector device in accordance with claim 5, wherein the gap is non-planar.

7. The collector device in accordance with claim 1, wherein the second end of the housing comprises a rigid bottom plate.

8. The collector device in accordance with claim 7, wherein the bottom plate includes at least one drain opening.

9. The collector device in accordance with claim 1, wherein the side portion of the housing comprises a flexible wall.

10. The collector device in accordance with claim 1, wherein the first end of the housing comprises a rigid top plate.

11. The collector device in accordance with claim 1, wherein the housing further comprises:

a vertical opening extending through the housing from the first end to the second end; and a gap extending from the first end to the second end and extending laterally from the vertical opening to the side portion;

wherein the gap is configured to slidingly receive the pipe coupling of the pipe string to transition the pipe collector to the active position.

12. The collector device of in accordance with claim 1, wherein the housing is U-shaped;

wherein the first end comprises a top plate;

wherein the second end comprises a bottom plate;

wherein the side portion comprises a side wall extending from the outer periphery of the top plate to the outer periphery of the bottom plate;

wherein the top plate includes a U-shaped recess extending from the outer periphery of the top plate and the bottom plate includes a U-shaped recess extending from the outer periphery of the bottom plate.

* * * * *